United States Patent [19]

Askins

[11] Patent Number: 4,801,136

[45] Date of Patent: Jan. 31, 1989

[54] SWIM TRAINING DEVICE

[76] Inventor: Craig Askins, P.O. Box 1126, Boston, Mass. 02134

[21] Appl. No.: 882,418

[22] Filed: Jul. 7, 1986

[51] Int. Cl.[4] ..... A63B 31/00

[52] U.S. Cl. ..... 272/71; 24/129 R

[58] Field of Search ..... 272/71, 74, 75, 143, 272/93, 133, 136, 132; 24/129 R, 115 A, 115 R, 541, 115 H, 136 L; 182/5; 128/132 R, 133, 134; 119/126-128

[56] References Cited

U.S. PATENT DOCUMENTS

| | | | |
|---|---|---|---|
| 836,431 | 11/1906 | Brooks | 24/129 R |
| 3,052,004 | 9/1962 | Wallshein | 24/129 R |
| 3,528,654 | 9/1970 | Larson et al. | 272/74 |
| 4,109,905 | 8/1978 | Meier | 272/71 |
| 4,245,839 | 1/1981 | Trent | 272/143 |
| 4,293,125 | 10/1981 | Hinds | 272/75 |
| 4,477,073 | 10/1984 | Koch et al. | 272/136 |

*Primary Examiner*—Richard J. Apley
*Assistant Examiner*—S. R. Crow
*Attorney, Agent, or Firm*—Reising, Ethington, Barnard, Perry & Milton

[57] ABSTRACT

The assembly is a swim exercise device to be secured around a support structure near the surface of water and includes a length of cord (12) with two loops (22, 34, or 134) formed at each end. The first loop (22) is formed by a first guide means (14) being made of flexible sheet material which is bent to align pairs of holes (16, 18) for threading of the cord (12) therethrough which naturally resists such folding motion to remain biased toward flat which grips and prevents movement of the cord (12) therethrough. The second loop (34, 134) is formed by a second guide means (38) or a flexible strap (54). The cord (12) is positioned around a support structure and the first loop (22) is threaded through the second loop (34, 134) and is pulled taut to secure the assembly near the surface of water for exercising. Variable resistance is obtained by using an elastic cord (12) and variable elasticity is accomplished by adjusting the length of cord (12) between the first loop (22) and the second loop (34, 134).

16 Claims, 3 Drawing Sheets

SWIM TRAINING DEVICE

TECHNICAL FIELD

The assembly relates to an exercise apparatus for use in a body of water for strengthening and developing the muscles of a person. The resistance of the assembly increases as a person exerts more forward force.

BACKGROUND ART

Swim exercising devices have been used in a swimming pool to hold a person stationary while a person is swimming. A swimmer can exercise continuously without having to stop at the end of a lap and turn around. One type of such device uses a cord wrapped twice around a person and the ends threaded through a ring for adjustment. The ends of the cord are attached to a support stand. The support stand comprises a vertical bracket bolted to the edge of a pool, with a second bracket attached to the vertical bracket and angularly disposed therefrom. The cord attaches to the second bracket to extend out over the water. U.S. Pat. No. 4,248,419 granted to George Hohwart, discloses such a system where the cord is attached to a separate support structure. A problem with this type of assembly is that once the assembly is installed, it is difficult to move. Also, the resistance of the device on a swimmer is non-variable.

Another type of assembly is one which includes a cord around a person whose ends are threaded through a plastic tube for adjustment purposes. The ends of the cord are secured to a hook which in turn secures to the pool. U.S. Pat. No. 4,109,905 Ernest Meier, discloses such a system where the cord passes through a tube for adjustment and the assembly secures to the pool by a hook. A problem arises with this assembly in that once the cord is secured around a person and the tube slid to adjust the length of cord around the person, there is a tendency for the cord to loosen about the person through slippage of the tube. Another problem arises when there is no support structure to receive a hook, and elasticity of the cord is not adjustable.

SUMMARY OF THE INVENTION AND ADVANTAGES

The invention relates to a swim exercise assembly adapted to be secured around a support structure near the surface of water which includes a single flexible cord which has two ends. A first guide means contains holes therethrough. The first end of the cord is threaded through the holes of the first guide means to create a first loop of material for securing around a person. The first guide means is characterized by being a sheet material foldable along a fold line by a predetermined force for aligning the holes to allow the cord to move therethrough for adjusting the length of the first loop around a person and for naturally resisting such folding motion to remain biased toward flat absent the predetermined force to grip and prevent movement of the cord once adjusted.

The invention further relates to a method for assembling a swim exercise assembly by forming a first bracket having a fold line thereacross with first and second pairs of aligned holes when folded together and forming the first pair of aligned holes with a larger diameter that the second pair of aligned holes.

The present invention solves the problem of the prior art by being easily adjustable about a person without slippage and having a universal attachment means to a support structure. The resistance of the device on a swimmer is variable and the elasticity of the cord can be adjusted to vary the range of variable resistance.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
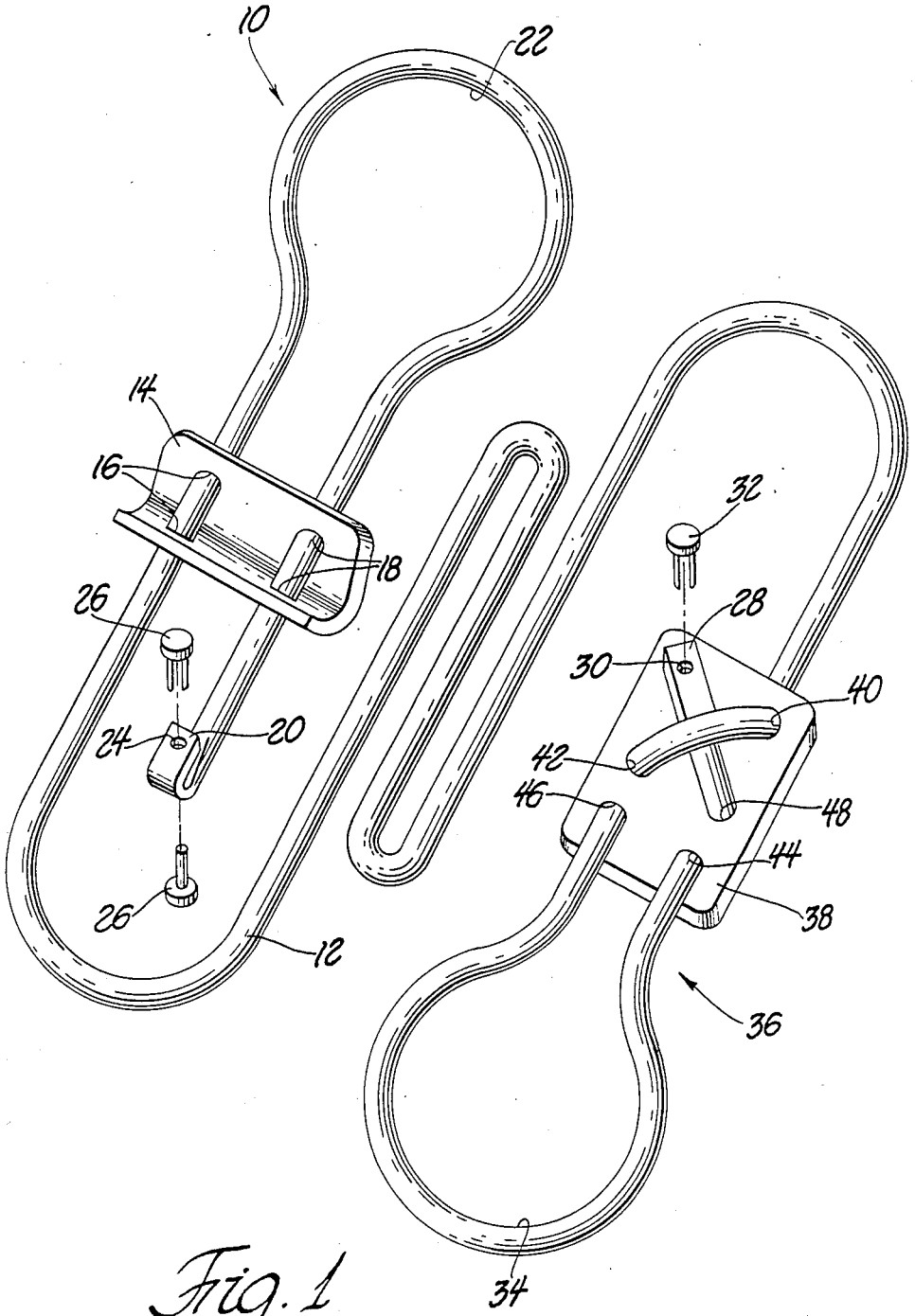
FIG. 1 is a perspective view of a first preferred embodiment of the subject invention.

A swim exercise assembly adapted to be secured around a support structure near the surface of water is generally shown at 10 in FIG. 1. A single flexible cord 12 containing two ends 20 and 28 is utilized in the assembly.

The assembly includes a first guide means 14 which contains four holes therethrough. There is a first pair of holes 16 with a diameter equal to the diameter of the cord 12 for freely threading the cord 12 therethrough. A second pair of holes 18 has a diameter less than the diameter of the cord 12 for preventing movement of the cord 12 through the second pair of the holes 18. The first end 20 of the cord 12 is threaded through the first pair of holes 16 and is rethreaded back through the first guide means 14 through the second pair of holes 18 creating a first loop 22 of the cord 12 for securing around a person. The first guide means 14 is made of a sheet material which is foldable along a fold line by a predetermined force for aligning the holes 16 and 18. The cord 12 extends through the aligned holes 16 and 18 for adjusting the length of the first loop 22 around a person. The first guide means 14 naturally or inherently resists such folding motion to remain biased toward flat absent the predetermined force to grip and prevent movement of the cord 12 once adjusted.

The first end 20 of the cord 12 contains two cord holes 24 therethrough with one behind the other with respect to the first end 20 of the cord 12. The two cord holes 24 are situated so that the cord 12 can be folded back upon itself aligning the two cord holes 24. The two cord holes 24 are of a diameter equal to that of a clamping means 26, which is preferably a pair of ratchet rivets. The two folded aligned cord holes 24 receive the clamping means 26 to prevent the cord 12 from sliding through and out of the first guide means 14. Slippage of the cord 12 is prevented by both the second pair of holes 18 having a smaller diameter than the cord 12 and the clamping means 26 resting against the first guide means 14.

To adjust the length of the first loop 22 around a person, the first guide means 14 is folded by the predetermined force to align the first pair of holes 16. The cord 12 can easily be moved through the first pair of holes 16 to increase or decrease the length of the first loop 22. After the adjustment is made, the first guide means 14 is released wherein it biases toward flat to grip and to prevent the cord 12 from readjusting itself or sliding through the first pair of holes 16. A sleeve of a soft material, not shown, may be secured around the cord 12 of the first loop 22 to aid in the comfort of the person.

A length of the cord 12 is between the first guide means 14 and a second end 28 of the cord 12. The second end 28 of the cord 12 has one clamping hole 30 therethrough with a diameter equal to the diameter of a second clamping means 32 and 132. The second end 28 forms a second loop 34 and 134 secured by the second clamping means 32 and 132, which is preferably a pair of ratchet rivets. The second loop 34, 134 is used as a means of securing the assembly to a support structure. The length of the cord 12 is wrapped on one side of a support structure, the first loop 22 is threaded through the second loop 34, 134, and the first loop 22 is extended to pull the second loop 34, 134 secure around the support structure. There are two preferred embodiments for creating the second loop 34, 134.

The first embodiment of the second loop 34 is shown at 36 in FIG. 1. The second end 28 of the cord 12 is threaded through a second guide means 38 which contains six holes 40, 42, 44, 46, 48 and 50. Five 40, 42, 44, 46 and 48 of the six holes have a diameter equal to that of the cord 12 and the sixth hole 50 has a diameter equal to that of the second clamping means 32. In this embodiment, the cord 12 is preferred to be elastic, wherein adjustment of the length of elastic cord 12 between the first 14 and second 38 guide means is accomplished by adjusting in the length of the second loop 34, which results in a change in elasticity of the assembly as a whole. In other words, if the cord 12 is adjusted to a shorter length, the elasticity the length that the cord can be extended is than if the cord 12 was adjusted to a longer length.

Figure 2:
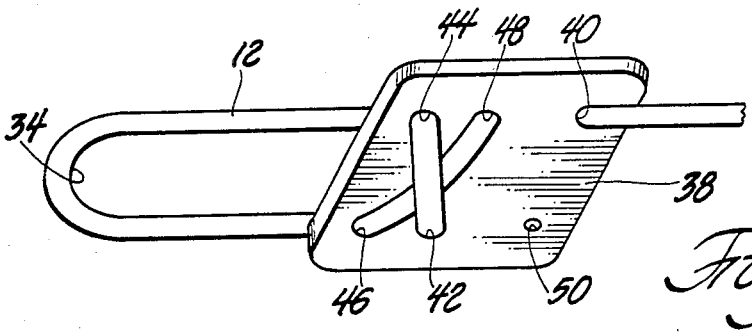
FIG. 2 is an underside view of a portion of the first preferred embodiment.

The second 28 of the cord 12 is threaded through the 40 of the six holes, through the second hole 42, and then through the third hole 44 and out the second guide means 38. The second loop 34 is formed by threading the second end 28 of the cord 12 back through the second guide means 38 through the fourth hole 46, into the fifth hole 48, and to the sixth hole 50. The sixth hole 50 and the clamping hole 30 in the second end 28 of the cord 12 are aligned and secured by the second clamping means 32. FIG. 2 illustrates the crossing pattern of the cord 12 on the underside of the second guide means 38 created by the cord 12 threaded from the second hole 42 to the third hole 44 overlapping the cord 12 threaded from the fourth hole 46 to the fifth 48. The crossing pattern aids in preventing slippage of the cord 12 to retain the length of the second loop 34.

Figure 3A:
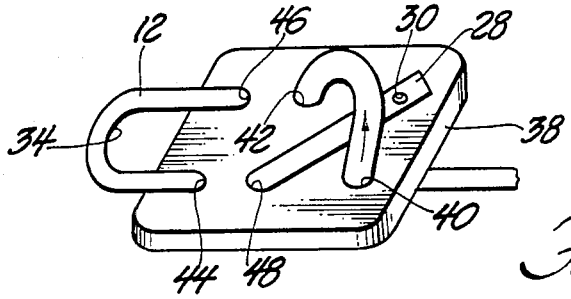
FIG. 3*a* is a perspective view showing the first step of an adjustment method.
Figure 3B:
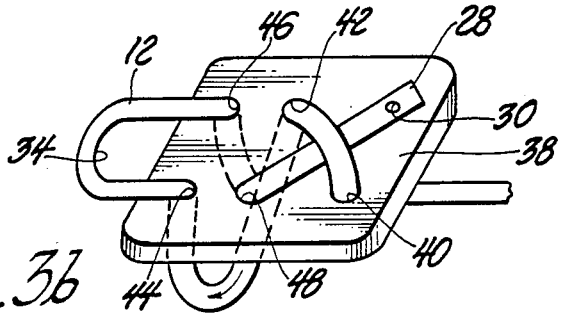
FIG. 3*b* is perspective view showing the second step of an adjustment method.
Figure 3C:
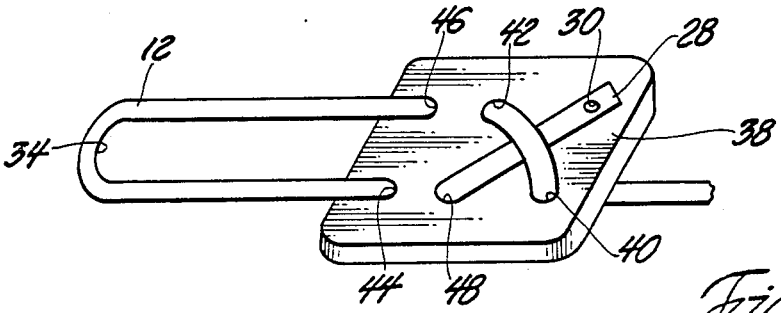
FIG. 3*c* is a perspective view showing the third step of an adjustment method.

FIG. 3 illustrates the adjustment method of the length of elastic cord 12 to change the elasticity of the assembly. As shown in FIG. 3*a*, the cord 12 is pulled between the first hole 40 and the second hole 42 creating slack between the first 40 and second 42 holes shortening the length of elastic cord 12 between the first guide means 14 and the second guide means 38. The cord 12 is then pulled between the second 42 and third 44 holes creating cord slack therebetween and eliminating the slack between the first 42 and second 44 holes, as shown in FIG. 3*b*. Finally, the second loop 34 is pulled eliminating the slack between the second 42 and third 44 holes and increasing the length of cord 12 of the second loop 34. This process will reduce the length of the elastic cord 12 between the first 14 and second 38 guide means and decrease the elasticity of the assembly. The reverse process is used to increase elasticity by increasing the length of elastic cord 12.

Figure 4:
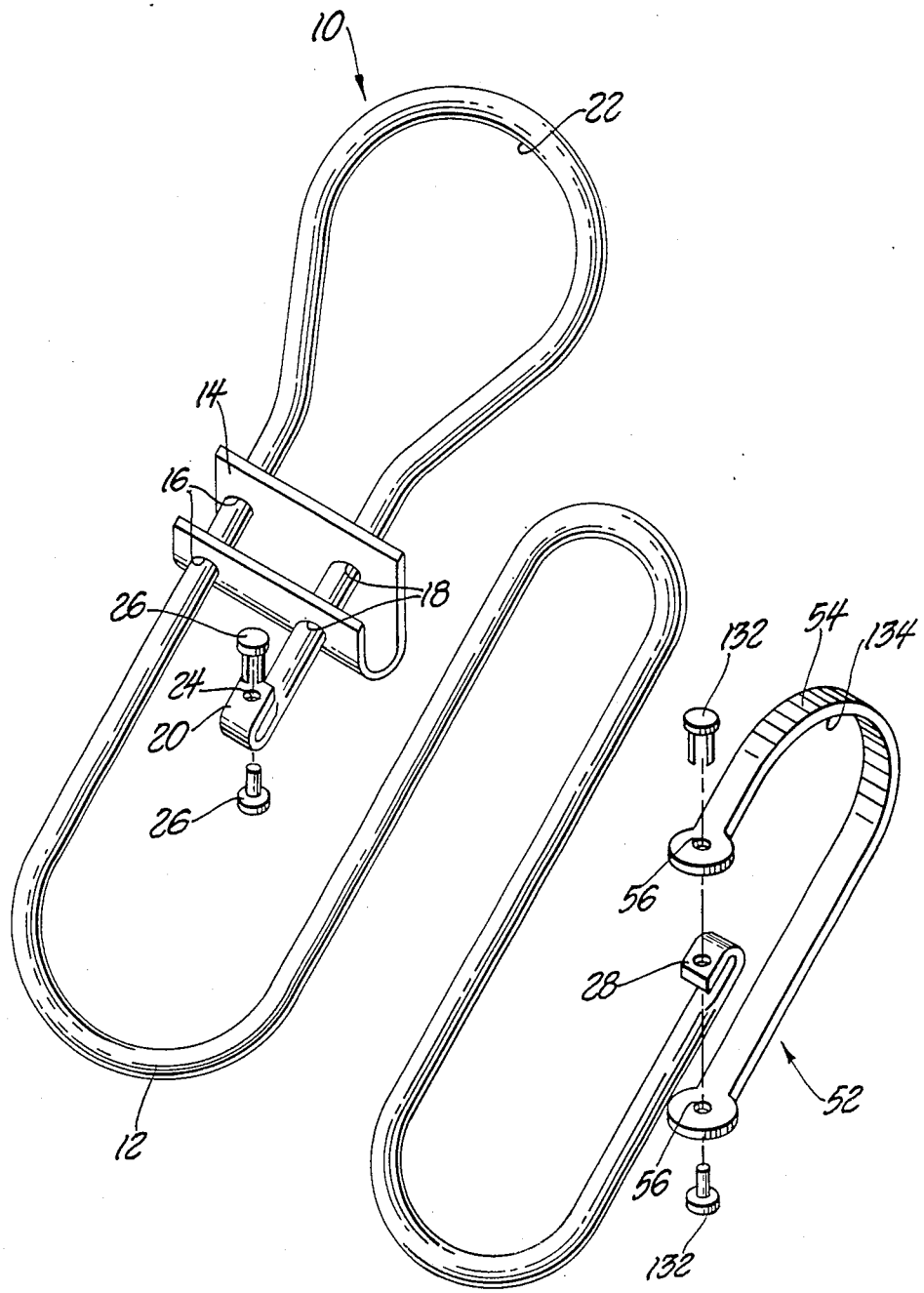
FIG. 4 is a perspective view of a second preferred embodiment of the subject invention.

The second embodiment of the second loop 134 is shown in FIG. 4 at 52. A separate flexible strap 54 with an end hole 56 through each end is used. The strap 54 is folded and secured to the second end 28 of the cord 12 with one end of the strap 54 on either side of the second end 28 of the cord 12 creating the second loop 134. The second clamping means 132 is secured through the aligned end holes 56 and the clamping hole 30.

The first 14 and second 38 guide means are preferably brackets. The brackets of the first and second guide means 14, 38 are made of a resilient plastic material. The flexible strap 54 is made of a flexible plastic material.

In either embodiment of the second loop 34, 134, the cord is made of an elastic material. The first embodiment of the second loop 34 allows for the elasticity to be varied by changing the length of the cord 12, whereas the second embodiment of the second loop 134 has a constant elasticity. Both embodiments of the second loop 34, 134 have variable resistance characteristics. As a swimmer exerts more energy, the length of the cord 12 is stretched further which results in more resistance being placed on the swimmer. If the swimmer relaxes and exerts less energy, the length of the cord will shorten thus reducing the resistance to a swimmer.

To make a swim exercise assembly, the first bracket 14 is formed having a fold line thereacross with a first 16 and a second 18 pair of aligned holes when folded together. The first pair of holes 16 have a larger diameter than the second pair of holes 18. The first braket 14 is folded to align the first 16 and second 18 pair of holes. The first end 20 of the cord 12 is threaded through the aligned first pair of holes 16 in the first bracket 14. The first end 20 of the cord 12 is then rethreaded through the second pair of holes 18 in the first bracket 14 creating a loop 22 of cord 12 between the first pair of holes 16 and second pair of holes 18 on the second side of the first guide means 14. The first end 20 of the cord 12 is bent to align the two holes 24 upon themselves and are secured together by a pair of ratchet rivets 26 to prevent the end of the cord 12 from sliding out of the second pair of holes 18 in the first bracket 14.

In the first preferred embodiment, the second bracket 38 is formed having six holes 40, 42, 44, 46, 48 and 50. The first five 40, 42, 44, 46 and 48 of the holes are formed with a diameter equal to that of the cord 12 and the sixth hole 50 with a diameter equal to that of the clamping means 32. The second end 28 of the cord 12 is threaded through the first hole 40, through the second hole 42, and then through the third hole 44 and out the second bracket 38. The second end 28 of the cord 12 is rethreaded through the fourth hole 46 of the second bracket 38, into the fifth hole 48 of the second bracket 38 and is clamped in a sixth hole 50 of the second bracket 38 with a rachet rivet 32.

The second preferred embodiment includes forming the flexible strap 54 with holes 56 through each end. The flexible strap 54 is folded upon itself with the ends on either side of the second end 28 of the cord 12 aligning the clamping hole 30 and the end holes 56. The ends of the flexible strap 54 are clamped to the second end 28 of the cord 12 by a rachet rivet 132.

The invention has been described in an illustrated manner, and it is to be understood that the terminology which has been used is intended to be in the nature of words of description rather than limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A swim exercise assembly adapted to be secured around a support structure near the surface of water, said device comprising; a single flexible cord (12) having first and second ends (20,28), a first guide means (14) containing first and second pairs of holes (16,18) therethrough, said first end (20) of said cord (12) threaded through said first pair of holes (16) of said first guide means (14) and secured to said first guide means by threading said cord (12) through said second pair of holes (18) to create a first loop (22) of said cord (12) between said pairs of holes (16, 18) for securing around a person, said first guide means (14) being a sheet material folded along a fold line extending between each of said first and second pairs of holes for folding in response to a predetermined force for aligning said pairs of holes (16, 18) to allow said cord (12) to move therethrough for adjusting the length of said first loop (22) around a person and for naturally resisting such folding motion to remain biased toward flat absent said predetermined force to grip and prevent movement of said cord (12) once adjusted.

2. An assembly as set forth in claim 1 further characterized by said first pair of holes (16) having a diameter equal to a diameter of said cord (12) for freely threading said cord (12) therethrough, and said second pair of holes (18) having a diameter less than said diameter of said cord (12) for preventing movement of said first end (20) of said cord (12) through said second pair of holes (18).

3. An assembly as set forth in claim 2 including a clamping means (26) to prevent slippage of said first end of said cord (12) through said first guide means (14), said first end (20) of said cord (12) containing two cord holes (24) therethrough for folding said cord (12) back upon itself to align said two cord holes (24) and to receive said clamping means (26) to prevent said cord (12) from sliding through and out of said first guide means (14).

4. An assembly as set forth in claim 2 including a second clamping means (32, 132) at said second end (28) of said cord (12) to form a second loop (34, 134) secured by a second clamping means (32) for receiving said first loop (22) through said second loop (34, 134) for wrapping said length of said cord (12) around a support structure and threading said first loop (22) through said second loop (34, 134) and extending said first loop (22) to pull said second loop (34, 134) secure around the support structure.

5. An assembly as set forth in claim 4 further characterized by said cord (12) being elastic for increasing the resistance of said assembly against a person proportional to the length said cord (12) is being stretched in response to the force of the person pulling away form the support structure.

6. An assembly as set forth in claim 5 including a second guide means (38) with six holes (40, 42, 44, 46, 48, 50) therethrough for threading said second end (28) of said cord (12) through said holes (40, 42, 44, 46, 48,50) to create said second loop (34) of said cord (12) to change the elasticity of said device by adjusting the length of said second loop (34) and to secure said assembly about a support structure.

7. An assembly as set forth in claim 6 further characterized by said second end (28) of said cord (12) being secured to said second guide means (38) by said second clamping means (32) to prevent said second end (28) of said cord (12) from sliding through said second guide means (38).

8. An assembly as set forth in claim 7 further characterized by five (40, 42, 44, 46, 48) of said six holes of said second guide means being equal to the diameter of said cord (12), and the sixth (50) of said six holes being equal to the diameter of said second clamping means (32).

9. An assembly as set forth in claim 8 including a second end (28) of said cord (12) containing one clamp hole (30) therethrough to align with said sixth hole (50) of said second guide means (38) and to be secured by said second clamping means (32) to prevent movement of said second end (28) of said cord (12) with respect to said second guide means (38).

10. An assembly as set forth in claim 9 further characterized by said first (14) and second (38) guide means being brackets.

11. An assembly as set forth in claim 10 further characterized by said bracket of said first guide means (14) being made of a resilient plastic material.

12. An assembly as set forth in claim 11 further characterized by said bracket of said second guide means (38) being made of a resilient plastic material.

13. An assembly as set forth in claim 5 further characterized by said assembly including a separate flexible strap (54) with an end for attachment to said second end (28) of said cord (12) hole (56) through each end.

14. An assembly as set forth in claim 13 further characterized by said strap (54) being looped and secured to said second end (28) of said cord (12) by said second clamping means (132) through said end holes (56) and said clamp hole (30).

15. An assembly as set forth in claim 14 further characterized by said second clamping means (132) being coupling rachet rivets.

16. An assembly as set forth in claim 15 further characterized by said flexible strap (54) being made of a flexible plastic material.

* * * * *